US007174645B2

(12) United States Patent
Kanzaki

(10) Patent No.: US 7,174,645 B2
(45) Date of Patent: Feb. 13, 2007

(54) METHOD FOR DESIGNING OF APROXIMATE ELLIPTICAL STRUCTURE AND THE SAME

(76) Inventor: Takahiro Kanzaki, 8-10, Honamanuma, 3-chome, Suginami-ku, Tokyo 167-0031 (JP)

( * ) Notice: Subject to any disclaimer, the term of this patent is extended or adjusted under 35 U.S.C. 154(b) by 0 days.

(21) Appl. No.: 10/713,147

(22) Filed: Nov. 17, 2003

(65) Prior Publication Data

US 2004/0139663 A1 Jul. 22, 2004

(30) Foreign Application Priority Data

Nov. 18, 2002 (JP) ..... 2002-371121

(51) Int. Cl.
*B43L 11/04* (2006.01)
*G06G 1/16* (2006.01)

(52) U.S. Cl. ..... 33/30.1; 33/1 G; 33/27.01; 434/214; 52/236.2

(58) Field of Classification Search ..... 33/1 G, 33/30.1–30.7, 518, 27.01, 27.02, 27.03, 561.1–561.3; 52/236.2, 245; 434/211, 213, 214
See application file for complete search history.

(56) References Cited

U.S. PATENT DOCUMENTS 520,003 A * 5/1894 Lehner ..... 33/30.4

(Continued)

FOREIGN PATENT DOCUMENTS

DE 10057636 C1 * 6/2002

(Continued)

OTHER PUBLICATIONS

J. B. Calvert, "Ellipse", Created May 6, 2002, http://du.edu/~jcalvert/math/ellipse.htm, pp. 1-7.*

(Continued)

*Primary Examiner*—Diego Gutierrez
*Assistant Examiner*—Amy R. Cohen
(74) *Attorney, Agent, or Firm*—Stites & Harbison PLLC; Douglas E. Jackson

(57) ABSTRACT

A method for designing an elliptical structure with an outline of an approximate elliptic curve, which is generated by connecting circular segments to one another, and an elliptical structure created on said method. A first fixed point is established outside the elliptical structure; from the first fixed point, a straight line segment is drawn to the farthest end point of the minor axis through the origin; a first circular segment is drawn from said farthest end point of the minor axis with the use of the first fixed point as the center and the first straight line segment having the same length as that of said straight line segment as the radius, through an arbitrary angle set at said first fixed point; a second fixed point is established on said first straight line segment; a second circular segment following said first circular segment is drawn with the use of the second fixed point as the center and the second straight line segment as the radius, through an arbitrary angle set at said second fixed point; this step is repeated as required; an nth circular segment following (n−1)th circular segment and ranging from the finish end of the (n−1)th circular segment to the major axis is drawn with the use of the intersecting point of (n−1)th straight line segment and the major axis as the center, and a part of the (n−1)th straight line segment as the radius; and these steps are used to draw a part of the outline in each of the other quadrants for drawing the entire outline.

4 Claims, 4 Drawing Sheets

U.S. PATENT DOCUMENTS

| | | | | | |
|---|---|---|---|---|---|
| 773,035 | A | * | 10/1904 | Smith | 33/27.01 |
| 2,677,890 | A | * | 5/1954 | Sifton | 33/30.7 |
| 2,692,432 | A | * | 10/1954 | Stanley | 33/1 B |
| 2,827,633 | A | * | 3/1958 | Himes | 29/464 |
| 2,924,021 | A | * | 2/1960 | Proett et al. | 33/518 |
| 2,970,312 | A | * | 1/1961 | Smith | 343/756 |
| 3,007,247 | A | * | 11/1961 | Boehm | 33/1 B |
| 3,046,660 | A | * | 7/1962 | Fuess | 33/1 B |
| 3,186,268 | A | * | 6/1965 | Nils | 82/11 |
| 3,438,532 | A | * | 4/1969 | Chibaeff | 220/565 |
| 3,472,033 | A | * | 10/1969 | Brown | 405/210 |
| 3,524,257 | A | * | 8/1970 | Jakubowski | 33/1 SD |
| 3,927,477 | A | * | 12/1975 | Harris | 33/561.2 |
| 3,994,108 | A | * | 11/1976 | Johnson | 52/247 |
| 4,532,714 | A | * | 8/1985 | Spinning | 33/561.2 |
| 4,665,664 | A | * | 5/1987 | Knight | 52/81.5 |
| 5,870,106 | A | * | 2/1999 | Langelaan | 345/441 |
| 6,192,634 | B1 | * | 2/2001 | Lopez | 52/81.2 |
| 6,405,444 | B1 | * | 6/2002 | Osborne | 33/27.031 |
| 6,415,518 | B1 | * | 7/2002 | Sims | 33/286 |
| 6,904,697 | B2 | * | 6/2005 | Zars | 33/760 |

FOREIGN PATENT DOCUMENTS

GB 2155969 A * 10/1985

OTHER PUBLICATIONS

Paul L. Rosin et al., "The Eillpse and the Five-centred Arch", last modified Jun. 22, 2004, http://users.cs.cf.ac.uk/Paul.Rosin/resources/papers, pp. 1-10.*

Paul L. Rosin, "On the Construction of Ovals", last modified May 11, 2004, http://users.cs.cf.ac.uk/Paul.Rosin/resources/papers, pp. 1-4.*

* cited by examiner

METHOD FOR DESIGNING OF APROXIMATE ELLIPTICAL STRUCTURE AND THE SAME

FIELD OF THE INVENTION

The present invention relates to a method for designing of an elliptical structure, and the same.

BACKGROUND

Conventional building structures are typically square, rectangular, and circular in horizontal section, and although some of them use walls having a variety of curves as outer walls and the like, structures which horizontal section is elliptical are not often encountered. If structures which outer walls partly adopts an elliptic curve can be encountered, those which are entirely elliptical in horizontal section, in other words, which entire perimeter forms an elliptical cylinder are rarely encountered. However, structures which horizontal section is elliptical are extremely graceful in shape, and have a high strength, therefore, as future building structures providing a novel feeling and a beautiful appearance, they can be greatly expected to be popularized.

Then, the present invention provides efficient and economic means for serving the design, drawing, land survey, manufacture, and construction in building an elliptical structure.

The elliptic curve is a quadratic curve which is characterized in that the sum of the distances from a particular point thereon to the two focuses of ellipse is constant. For drawing an elliptic curve, two coordinate points which are to be on the elliptic curve may be connected to each other with a single straight line as a convenient method, or with a polygonal line approximate to the elliptic curve as a more precise method. However, for connecting two coordinate points to each other with a polygonal line, the distance between the two coordinate points must be finely divided, and minute polygonal line components must be drawn, being connected to one another. Therefore, to connect two coordinate points by means of such a polygonal line to provide an approximate elliptic curve, complex computations and operations are required. Thus, using such an approximate elliptic curve which is thus obtained means that it requires intricate calculations and drawings in designing an elliptical structure, and that it is not efficient, economical, and feasible in land surveying on the building site for the elliptical structure, and fabricating member materials for the structure.

SUMMARY OF THE INVENTION

The present invention eliminates these problems by connecting circular segments to provide an approximate elliptic curve. The locus of a circle is determined depending upon the center and the radius, and thus a circular segment can be easily drawn. Therefore, connecting circular segments to generate an approximate elliptic curve makes the design and drawing of elliptical structures substantially more efficient and provides feasible means for constructing elliptical structures.

The first purpose of the present invention is to provide an approximate elliptic curve for an elliptical structure by connecting circular segments.

The second purpose of the present invention is to provide a method for designing an elliptical structure efficiently, economically, and practically by connecting circular segments to generate an approximate elliptic curve.

The third purpose of the present invention is to provide an elliptical structure which can be efficiently, economically and practically designed by connecting circular segments to generate an approximate elliptic curve.

These purposes can be achieved by the present invention, which embodiments will be described here with reference to the accompanying drawings. It is needless to say that any possible modifications and variations of the present invention can be covered by the claims which are later given.

As shown in the accompanying drawings which are described later, the present invention provides the following items [1], [2], and [3]:

[1] A method for designing an elliptical structure (A) which is symmetrical about the major axis (M) and the minor axis (N) thereof, and has an outline ($B_1$) of an approximate elliptic curve, comprising the steps of:

a) establishing a first fixed point ($C_1$) outside the elliptical structure (A); from the first fixed point ($C_1$), drawing a straight line segment ($L_0$) to the farthest end point of the minor axis (N) through the intersecting point (o) of the major axis (M) and the minor axis (N); and drawing a first circular segment ($d_1$) from said farthest end point ($P_0$) of the minor axis (N) with the use of the first fixed point ($C_1$) as the center and the first straight line segment ($L_1$) having the same length as that of said straight line segment ($L_0$) as the radius, through an arbitrary angle a $\alpha_1$ set at said first fixed point ($C_1$);

b) establishing a second fixed point ($C_2$) on said first straight line segment ($L_1$); and drawing a second circular segment ($d_2$) following said first circular segment ($d_1$) with the use of the second fixed point ($C_2$) as the center and the second straight line segment ($L_2$) as the radius, through an arbitrary angle a $\alpha_2$ set at said second fixed point ($C_2$);

c) establishing a third fixed point ($C_3$) on said second straight line segment ($L_2$); and drawing a third circular segment ($d_3$) following said second circular segment ($d_2$) with the use of the third fixed point ($C_3$) as the center and the third straight line segment ($L_3$) as the radius, through an arbitrary angle $\alpha_3$ set at said third fixed point ($C_3$);

d) repeating this step as required;

e) finally drawing an nth circular segment ($d_n$) following (n−1)th circular segment ($d_{n-1}$) and ranging from the finish end ($P_{n-1}$) of the (n−1)th circular segment ($d_{n-1}$) to the major axis (M) with the use of the intersecting point ($C_n$) of (n−1)th straight line segment ($L_{n-1}$) and the major axis (M) as the center, and a part of the (n−1)th straight line segment ($L_{n-1}$) as the radius; and f) using these steps to draw a part of the outline ($B_1$) in each of the other quadrants for drawing the entire outline ($B_1$).

[2] A method for designing an elliptical structure (A) which is symmetrical about the major axis (M) and the minor axis (N) thereof, and has an outline ($B_2$) of an approximate elliptic curve, comprising the steps of:

a) establishing a first fixed point (C,) outside the elliptical structure (A); from the first fixed point ($C_1$), drawing a straight line segment ($L_0$) to the farthest end point ($P_0$) of the minor axis (N) through the intersecting point (o) of the major axis (M) and the minor axis (N); and drawing a first circular segment ($d_{10}$) from said farthest end point ($P_0$) of the minor axis (N) with the use of the first fixed point ($C_1$) as the center and a first straight line segment ($L_{10}$) having the same length as the straight line segment ($L_0$) as the radius, through an arbitrary angle $\alpha_1$ set at said first fixed point ($C_1$);

b) establishing a second fixed point ($C_{20}$) on said first straight line segment ($L_{10}$); and drawing a second circular segment ($d_{20}$) following said first circular segment ($d_{10}$) with the use of the second fixed point ($C_{20}$) as the center and the second straight line segment ($L_{20}$) as the radius, through an arbitrary angle $\alpha_2$ set at said second fixed point ($C_{20}$);

c) finally drawing a third circular segment ($d_{30}$) following the second circular segment ($d_{20}$) and ranging from the finish end ($P_{20}$) of the second circular segment ($d_{20}$) to the major axis (M) with the use of the intersecting point ($C_{30}$) of the second straight line segment ($L_{20}$) and the major axis (M) as the center, and a part of the second straight line segment ($L_{20}$) as the radius; and d) using these steps to draw a part of the outline ($B_2$) in each of the other quadrants for drawing the entire outline ($B_2$).

[3] An elliptical structure (A) which has an outline ($B_1$), ($B_2$) of an approximate elliptic curve, being constructed using building materials designed by the method as mentioned in either of the item [1] and item [2].

DESCRIPTION OF THE PREFERRED EMBODIMENT

Figure 1:
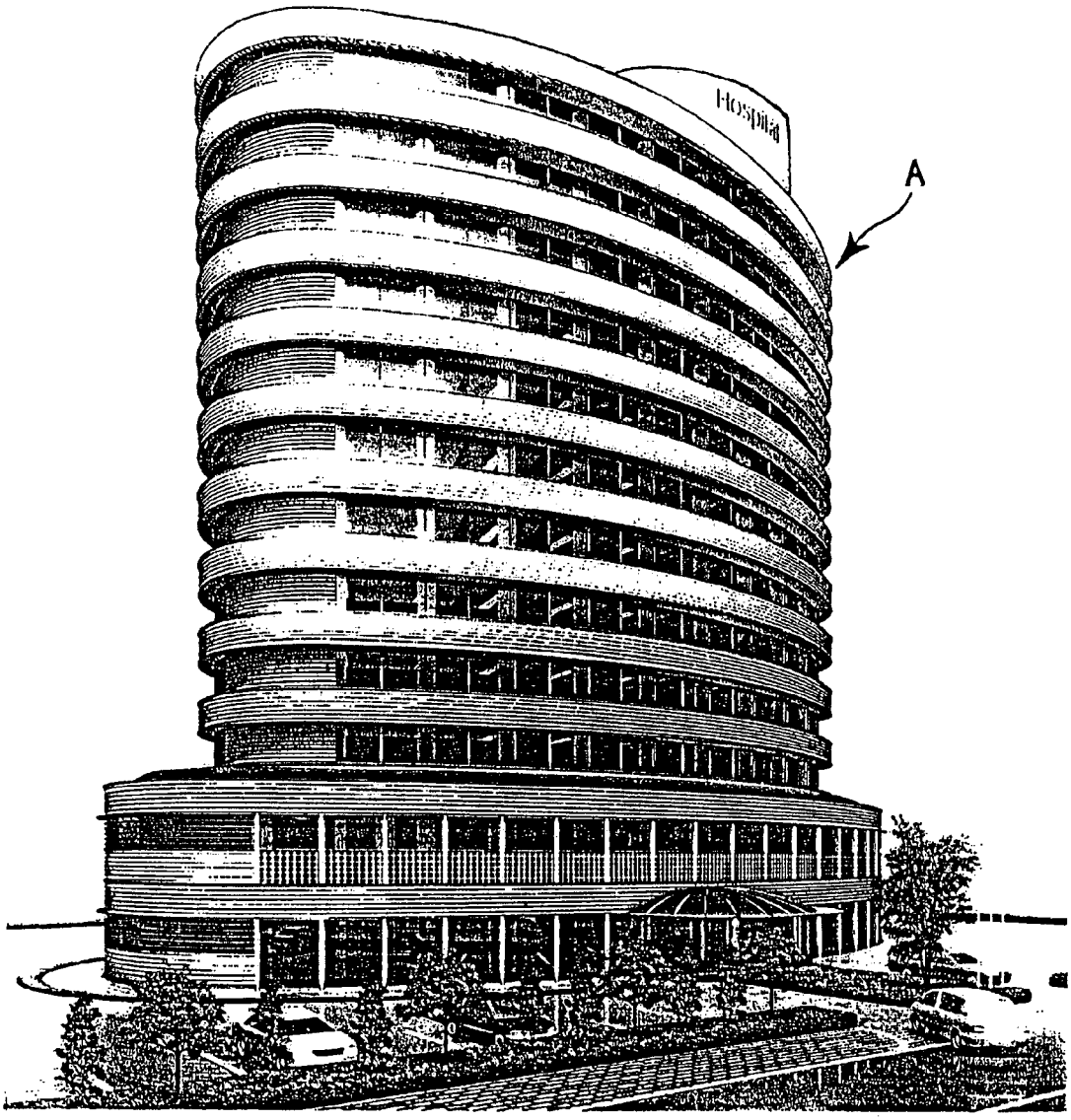
FIG. 1 shows a bird's eye view of an elliptical structure (A) to be built on the present invention.
Figure 2:
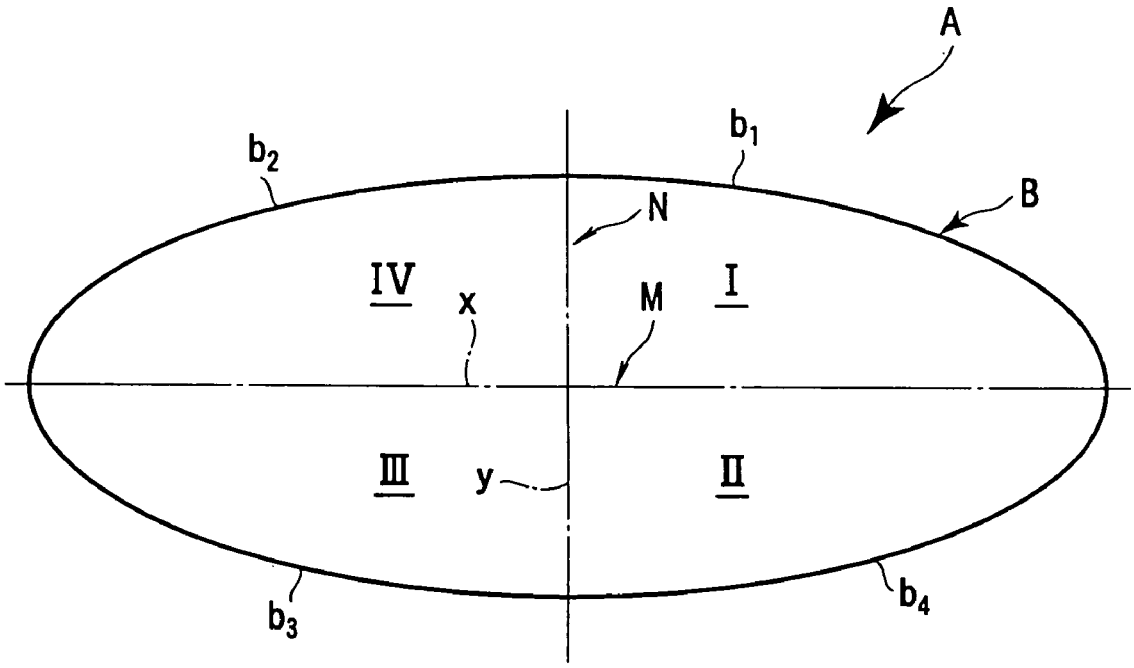
FIG. 2 is an example of elliptic curve drawn for the elliptical structure as shown in FIG. 1.

FIG. 1 shows a bird's eye view of an elliptical structure (A) to be built on the present invention. FIG. 2 is an example of elliptic curve drawn for the elliptical structure (A) as shown in FIG. 1, which outline or perimeter basically forms an ellipse, the elliptic curve being provided as a result of mathematical computation made by manual operation or by using such means as a computer. The elliptic curve has a major axis (M) and a minor axis (N) on the coordinate axes x and y (providing center lines), respectively, a partial outline ($b_1$), ($b_2$), ($b_3$), and ($b_4$) in the first quadrant (I), the second quadrant (II), the third quadrant (III), and the fourth quadrant (IV), respectively, being connected to one another to provide a complete outline (B) which forms an ellipse, and the elliptic curve is symmetrical about the major axis (M) and also about the minor axis (N).

Thus, with the present invention, the elliptic curve for the elliptical structure (A) is provided by connecting circular segments to one another.

Figure 3:
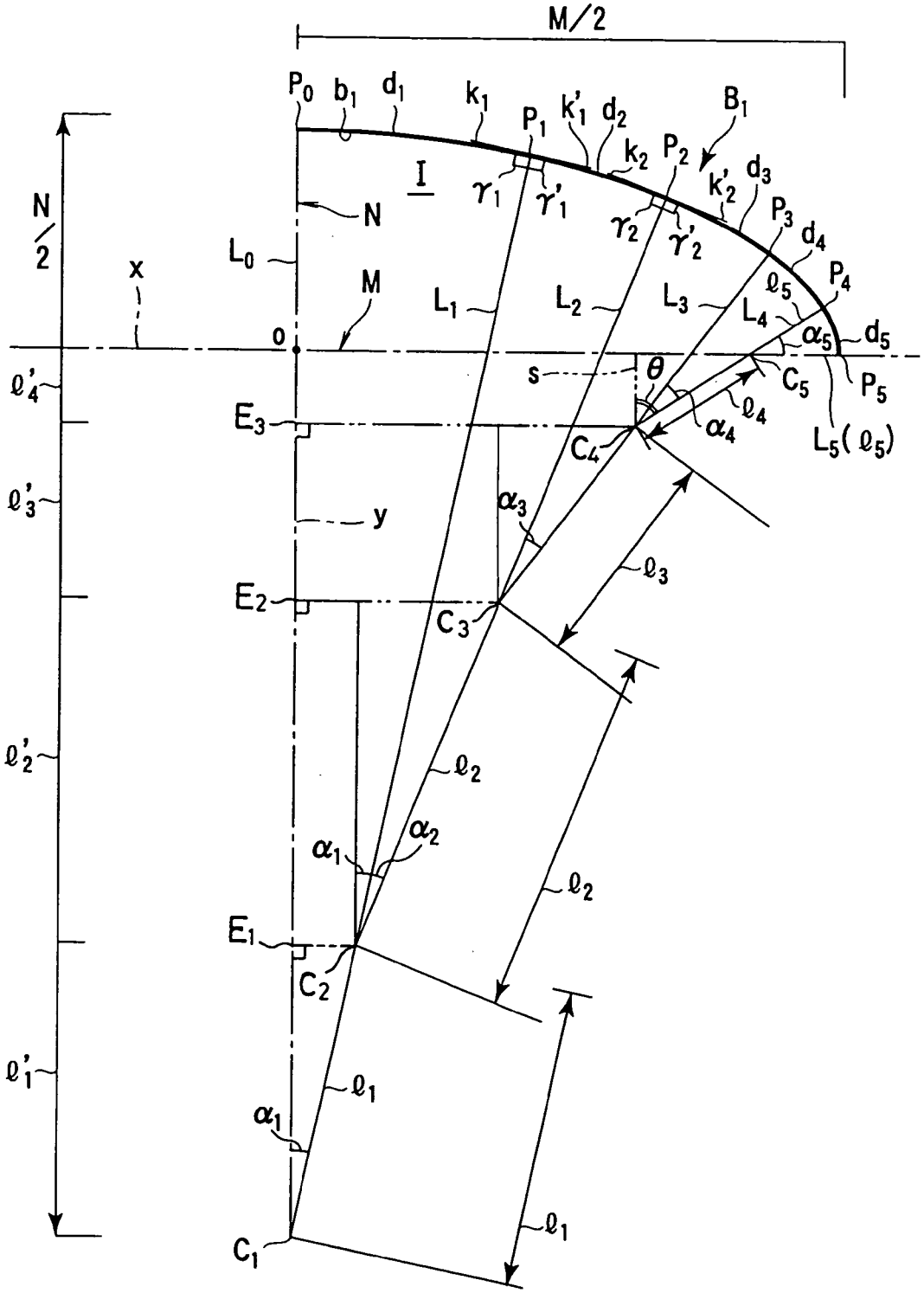
FIG. 3 shows an embodiment of the method for designing an elliptical structure according to the present invention.

Specifically, as shown in FIG. 3, an outline ($B_1$) approximating said outline (B) is created by connecting circular segments to one another. In other words, the major axis (M) and the minor axis (N) for the outline ($B_1$), i.e., the coordinate axes x and y are established, and a first fixed point ($C_1$) is established on the coordinate axis y. By drawing a straight line segment ($L_0$), which has a length equal to half the length of the previously established minor axis (N) plus the length from the first fixed point ($C_1$) to the major axis (M), i.e., the origin (o), which is the intersecting point of the major axis (M) and the minor axis (N), a point ($P_0$) which must exist on the outline ($B_1$) is determined. An angle $\alpha_1$ is set at said first fixed point ($C_1$), and a first circular segment ($d_1$) is drawn from the point ($P_0$) to a point ($P_1$) with the first fixed point ($C_1$) being used as the center, and a first straight line segment ($L_1$), which length is set at the same as the length of the straight line segment ($L_0$), being used as the radius. In this context, the point ($P_1$) provides a point where a first tangent line segment ($k_1$) at the end of the first circular segment ($d_1$) forms a right angle with the first straight line segment ($L_1$), in other words, an angle $\gamma_1$ at the point ($P_1$) is 90 deg. The first circular segment ($d_1$) drawn provides the partial outline ($b_1$) as mentioned above.

Next, a point distant from the first fixed point ($C_1$) by an arbitrary length $l_1$. is established as a second fixed point ($C_2$) on the first straight line segment ($L_3$); an angle of $\alpha_2$ is set to draw a second straight line segment ($L_2$) to a point ($P_2$); and with the second fixed point ($C_2$) being used as the center, and the second straight line segment ($L_2$) being used as the radius, a second circular segment ($d_2$), which follows the first circular segment ($d_1$), is drawn to the point ($P_2$). The beginning of the second circular segment ($d_2$) provides a point where a second tangent line segment ($k'_1$) at the start end of the second circular segment ($d_2$) forms a right angle with the first straight line segment ($L_1$), in other words, an angle $\gamma'_1$ at the point ($P_1$) is 90 deg. Thus, the angle $\gamma_1$ plus the angle $\gamma'_1$ is equal to 180 deg, and at the point ($P_1$), the first tangent line segment ($k_1$) for the first circular segment ($d_1$) and the second tangent line segment ($k'_1$) at the start end of the second circular segment ($d_2$) form a straight line segment, thereby the first circular segment ($d_1$) drawn previously and the second circular segment ($d_2$) drawn subsequently are smoothly and curvedly connected to each other with no offset being produced.

Next, a point distant from the second fixed point ($C_2$) by an arbitrary length $l_2$ is established as a third fixed point ($C_3$) on the second straight line segment ($L_2$); an angle of $\alpha_3$ is set to draw a third straight line segment ($L_3$) to a point ($P_3$); and with the third fixed point ($C_3$) being used as the center, and the third straight line segment ($L_3$) being used as the radius, a third circular segment ($d_3$), which follows the second circular segment ($d_2$), is drawn to the point ($P_3$). The beginning of the third circular segment ($d_3$) provides a point where a third tangent line segment ($k_2$) at the finish end of the second circular segment ($d_2$) and a fourth tangent line segment ($k'_2$) at the start end of the third circular segment ($d_3$) form a right angle with the second straight line segment ($L_2$), respectively, in other words, an angle $\gamma_2$, $\gamma'_2$ at the point ($P_2$) is 90 deg. Thus, the angle $\gamma_2$ plus the angle $\gamma'_2$ is equal to 180 deg, and at the point ($P_2$), the third tangent line segment ($k_2$) for the second circular segment ($d_2$) and the fourth tangent line segment ($k'_2$) for the third circular segment ($d_3$) form a straight line segment, thereby the second circular segment ($d_2$) drawn previously and the third circular segment ($d_3$) drawn subsequently are smoothly and curvedly connected to each other with no offset being produced.

Next, a point distant from the third fixed point ($C_3$) by an arbitrary length $l_3$ is established as a fourth fixed point ($C_4$) on the third straight line segment ($L_3$); an angle of $\alpha_4$ is set to draw a fourth straight line segment ($L_4$) to a point ($P_4$); a point where the major axis (M) intersects with the fourth straight line segment ($L_4$) is established as a fifth fixed point ($C_5$), which is the final fixed point; and a fifth circular segment ($d_5$), which follows the fourth circular segment ($d_4$), is drawn to the major axis (M) to provide a point ($P_5$). By this, one end of the major axis (M) is actually established. The angle which the third straight line segment ($L_3$) forms with tangent line segments at the point ($P_3$) and that which the fourth straight line segment ($L_4$) forms with tangent line segments at the point ($P_4$) are 180 deg (as a result of 90 deg plus 90 deg), respectively, as is the case at the point ($P_2$). In this way, a partial outline ($b_1$) is sequentially formed in the first quadrant (I) for the outline ($B_1$).

If the values of angles $\alpha_1$, $\alpha_2$, $\alpha_3$, and $\alpha_4$, and the values of lengths $l_1 l_2$, and $l_3$ are given, the values of lengths $l_4$ and $l_5$ can be determined by calculation (as later described). Then, as can be easily conjectured from FIG. 4 (although this figure illustrates another embodiment of the present invention), the same technique is used to draw a partial outline ($b_2$) at left of the first fixed point ($C_1$) in the second quadrant (II) for the outline ($B_1$), and for the third quadrant (III) and the fourth quadrant (IV), a fixed point ($C'_1$) is established at the point symmetrical to the first fixed point ($C_1$), and by the same technique, partial outlines ($b_3$) and ($b_4$) are drawn. Now, said entire outline ($B_1$) has been formed by these partial outlines ($b_1$), ($b_2$), ($b_3$) and ($b_4$). By increasing the number of angles $\alpha$, as $\alpha_1$, $\alpha_2$, $\alpha_3$, $\alpha_4$, and $\alpha_5$, . . . , and the number of straight line segments L, as $L_1$, $L_2$, $L_3$, and $L_4$, . . . , the deviation of the components of the outline ($B_1$) from the corresponding components of the real elliptic curve can be decreased, in other words, the precision of the outline ($B_1$) created can be enhanced.

In FIG. 3, the length of the straight line segment ($L_0$) is equal to the distance between the first fixed point ($C_1$) and the point ($P_0$); the length of the first straight line segment ($L_1$) is equal to the distance between the first fixed point ($C_1$) and the point ($P_1$); the length of the second straight line segment ($L_2$) is equal to the distance between the second fixed point ($C_2$) and the point ($P_2$); the length of the fourth straight line segment ($L_4$) is equal to the distance between the fourth fixed point ($C_4$) and the point ($P_4$); (although it is not indicated in the figure), the length of the nth straight line segment ($L_n$) is equal to the distance between the nth fixed point ($C_n$) and the point ($P_n$); and the intersecting point of the major axis (M) and the (n−1)th straight line segment ($L_{n-1}$) provide the nth fixed point ($C_n$), which is the final fixed point.

Further, in FIG. 3, the length $l_1$ is equal to the distance between the first fixed point ($C_1$) and the second fixed point ($C_2$); the length $l_2$ is equal to the distance between the second fixed point ($C_2$) and the third fixed point ($C_3$); the length $l_3$ is equal to the distance between the third fixed point ($C_3$) and the fourth fixed point ($C_4$); the length $l_4$ is equal to the distance between the fourth fixed point ($C_4$) and the fifth fixed point ($C_5$); and here the distance between the fifth fixed point ($C_5$) and the point ($P_4$) is equal to the distance between the fifth fixed point ($C_5$) and the point ($P_5$), therefore, the length of the fifth straight line segment ($L_5$) is equal to the length $l_5$. Here, the length of the fifth straight line segment ($L_5$) is equal to the distance between the fifth fixed point ($C_5$) and the point ($P_5$), which is equal to the length of the fourth straight line segment ($L_4$) minus the length $l_4$. The fifth fixed point ($C_5$) is said final fixed point, which provides the intersecting point of the fourth straight line segment ($L_4$) drawn from the fourth fixed point ($C_4$) and the major axis (M). By drawing a fifth circular segment ($d_5$), which follows the fourth circular segment ($d_4$), from the point ($P_4$) to the major axis (M), with the fifth fixed point ($C_5$) being used as the center, said point ($P_5$) is provided. Thereby, as stated above, the partial outline ($b_1$) is completed in the first quadrant. Here, if a straight line segment (s) which is parallel to the y axis is drawn from the fourth fixed point ($C_4$) toward the x axis, the angle θ formed between the straight line segment (s) and the fourth straight line segment ($L_4$) is equal to the sum of the angles $\alpha_1$, $\alpha_2$, $\alpha_3$, and $\alpha_4$.

Hereinbelow, it will be described that, by arbitrarily determining the distance between the first fixed point ($C_1$) and the point ($P_0$), the distance between the first fixed point ($C_1$) and the origin (o), half the length of the minor axis (N), i.e., [N/2], the lengths $l_1$, $l_2$, and $l_3$, the angles $\alpha_1$, $\alpha_2$, $\alpha_3$, and $\alpha_4$, the lengths $l_4$ and $l_5$ can be determined. In FIG. 3, it is assumed that the intersecting point of a straight line drawn from the second fixed point ($C_2$) in parallel with the x axis and intersecting with the y axis is $E_1$, the distance between the first fixed point ($C_1$) and $E_1$ is $l'_1$; the intersecting point of a straight line drawn from the third fixed point ($C_3$) in parallel with the x axis and intersecting with the y axis is $E_2$, the distance between $E_1$ and $E_2$ is $l'_2$; and the intersecting point of a straight line drawn from the fourth fixed point ($C_4$) in parallel with the x axis and intersecting with the y axis is $E_3$, the distance between $E_2$ and $E_3$ is $l'_3$. Then, $l'_2$ is equal to the distance between $E_1$ and $E_2$; $l'_3$ is equal to the distance between $E_2$ and $E_3$; and $l'_4$ is equal to the distance between $E_3$ and the origin (o). Here is a description using mathematical expressions.

$$\cos\alpha_1 = \frac{l'_1}{l_1}$$

$$l_1 = \frac{l'_1}{\cos\alpha_1} \qquad l'_1 = l_1\cos\alpha_1 \tag{1}$$

$$l_2 = \frac{l'_2}{\cos(\alpha_1+\alpha_2)} \qquad l'_2 = l_2\cos(\alpha_1+\alpha_2) \tag{2}$$

$$l_3 = \frac{l'_3}{\cos(\alpha_1+\alpha_2+\alpha_3)} \qquad l'_3 = l_3\cos(\alpha_1+\alpha_2+\alpha_3) \tag{3}$$

If $C_{1,0}$ denotes the distance between $C_1$ and o, and $P_0$, $C_1$ the distance between $P_0$ and $C_1$, $$C_{1,0}=P_0,\ C_1-N/2$$

is a known number, and $l'_1$, $l'_2$, and $l'_3$ can be calculated from the above equations (1), (2), and (3), thus, $l'_4$ can be determined from the equation:

$$l'_4=C_{1,0}-l'_1-l'_2-l'_3$$

Then, by the equation:

$$\cos\theta = \frac{l'_4}{l_4}$$

the value of $l_4$ can be determined as follows:

$$l_4 = \frac{l'_4}{\cos\theta}$$

where θ is expressed by the following equation:

$$\theta=\alpha_1+\alpha_2+\alpha_3+\alpha_4$$

Then, the length of the fourth straight line segment ($L_4$) is equal to the length of the straight line segment ($L_0$) minus ($l_1+l_2+l_3$), and $l_5$ is equal to the length of $L_4$ minus $l_4$, thus, the value of $l_5$ can be calculated.

The length of the nth straight line segment ($L_n$), where $n \geqq 2$, is equal to the length of the (n−1)th straight line segment ($L_{n-1}$) minus $l_{n-1}$, where $l_{n-1}$ is expressed by the following equation:

$$l_{n-1} = \frac{l'_{n-1}}{\cos(\alpha_1 + \alpha_2 + \cdots + \alpha_{n-1})}$$

Figure 4:
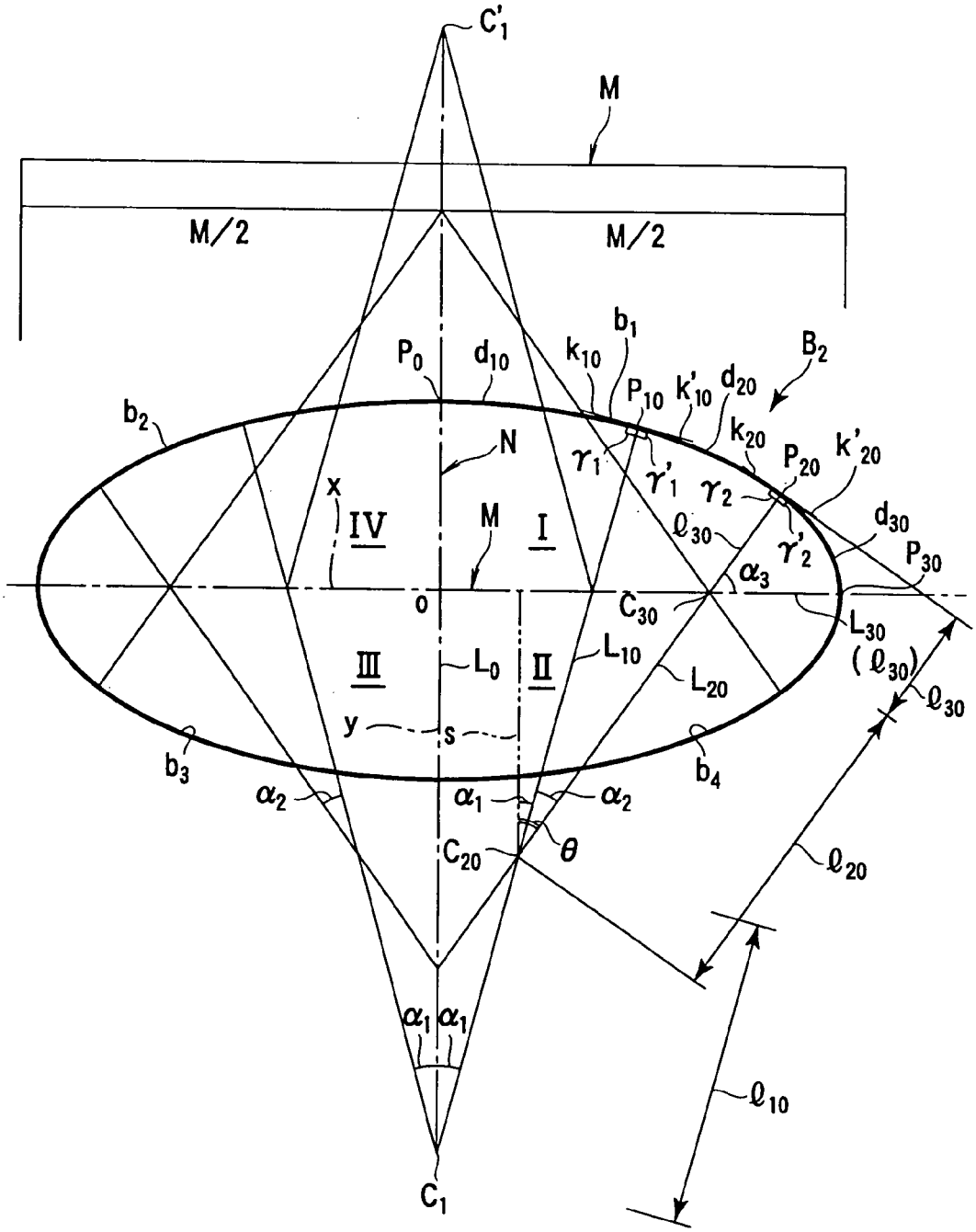
FIG. 4 shows another embodiment of the method for designing an elliptical structure according to the present invention.

FIG. 4 shows another embodiment. In FIG. 4, to create an outline ($B_2$) which approximate said outline (B), the major axis (M) and the minor axis (N) for the outline ($B_2$) of a building (A), i.e., the coordinate axes x and y are established; a first fixed point ($C_1$) is established on the coordinate axis y; by drawing a straight line segment ($L_0$), which has a length equal to half the length of the previously established minor axis (N) plus the length from the first fixed point ($C_1$) to the major axis (M), i.e., the origin (o), which is the intersecting point of the major axis (M) and the minor axis (N), a point ($P_0$) which must exist on the outline ($B_2$) is determined; an angle $\alpha_1$ is set at said first fixed point ($C_1$); a first circular segment ($d_{10}$) is drawn from the point ($P_0$) to a point ($P_{10}$) with the first fixed point ($C_1$) being used as the center, and a first straight line segment ($L_{10}$), which length is set at the same as the length of the straight line segment ($L_0$), being used as the radius. The point ($P_{10}$) provides a point where an angle $\gamma_1$ at the point ($P_{10}$) is 90 deg, in other words, a first tangent line segment ($k_{10}$) at the end of the first circular segment ($d_{10}$) forms a right angle with the first straight line segment ($L_{10}$).

Next, a point distant from the first fixed point ($C_1$) by an arbitrary length $l_{10}$ is established as a second fixed point ($C_{20}$) on the first straight line segment ($L_{10}$); An angle of $\alpha_2$ is set to draw a second straight line segment ($L_{20}$) to a point ($P_{20}$); and with the second fixed point ($C_{20}$) being used as the center, and the second straight line segment ($L_{20}$) being used as the radius, a second circular segment ($d_{20}$), which follows the first circular segment ($d_{10}$), is drawn to the point ($P_{20}$). The beginning of the second circular segment ($d_{20}$) provides a point where a second tangent line segment ($k'_{10}$) at the start end of the second circular segment ($d_{20}$) forms a right angle with the first straight line segment ($L_{10}$), in other words, an angle $\gamma'_1$ at the point ($P_{10}$) is 90 deg. Thus, the angle $\gamma_1$ plus the angle $\gamma'_1$ is equal to 180 deg, and at the point ($P_{10}$), the first tangent line segment ($k_{10}$) for the first circular segment ($d_{10}$) and the second tangent line segment ($k'_{10}$) at the start end of the second circular segment ($d_{20}$) form a straight line segment, thereby the first circular segment ($d_{10}$) drawn previously and the second circular segment ($d_{20}$) drawn subsequently are smoothly and curvedly connected to each other with no offset being produced.

Also at the point ($P_{20}$), the angle $\gamma_2$ plus the angle $\gamma'_2$ is equal to 180 deg, and at the point ($P_{20}$), a third tangent line segment ($k_{20}$) for the second circular segment ($d_{20}$) and a fourth tangent line segment ($k'_{20}$) at the start end of a third circular segment ($d_{30}$) (later described) form a straight line segment, thereby the second circular segment ($d_{20}$) drawn previously and the third circular segment ($d_{30}$) drawn subsequently are smoothly and curvedly connected to each other with no offset being produced.

In this case, the second circular segment ($d_{20}$) intersects with the major axis at an angle of $\alpha_3$, and the sum of the angles $\alpha_1$, $\alpha_2$, and $\alpha_3$ is equal to 90°. By using this intersecting point as a third fixed point ($C_{30}$) (the final fixed point), the third circular segment ($d_{30}$), which follows the second circular segment ($d_{20}$), is drawn to the major axis (M). Thereby, one end of the major axis (M), i.e., a point ($P_{30}$), is determined. In this way, a partial outline ($b_1$) is sequentially formed in the first quadrant (I) for the outline ($B_2$).

In FIG. 4, the length of the straight line segment ($L_0$) is equal to the distance between the first fixed point ($C_1$) and the point ($P_0$); the length of the first straight line segment ($L_{10}$) is equal to the distance between the first fixed point ($C_1$) and the point ($P_{10}$); and the length of the second straight line segment ($L_{20}$) is equal to the distance between the second fixed point ($C_{20}$) and the point ($P_{20}$). Therefore, if the values of angles $\alpha_1$ and $\alpha_2$, and the value of length $l_{10}$ are given, the length of the second straight line segment ($L_{20}$) is determined, and the values of lengths $l_{20}$ and $l_{30}$ can be determined by calculation. In other words, if the third fixed point ($C_{30}$) is established, the length $l_{20}$ can be determined, and thus the length $l_{30}$ can be determined from the relationship: the length $l_{30}$ is equal to the length of the second straight line segment ($L_{20}$) subtracted by the length $l_{20}$.

Thus, also in the present embodiment, the elliptic curve for an elliptical structure (A) can be formed by connecting circular segments to one another.

Then, as shown in FIG. 4, the same technique is used to draw a partial outline ($b_2$) at left of the first fixed point ($C_1$) in the second quadrant (II) for the outline ($B_2$), and for the third quadrant (III) and the fourth quadrant (IV), a fixed point ($C'_1$) is established at the point symmetrical to the first fixed point ($C_1$), and by the same technique, partial outlines ($b_3$) and ($b_4$) are drawn. Now, said entire outline ($B_2$) has been formed by these partial outlines ($b_1$), ($b_2$), ($b_3$) and ($b_4$).

Thus, with the present invention, the members based on the first circular segment ($d_1$) to the fifth circular segment ($d_5$), and the first circular segment ($d_1$) to the third circular segment ($d_3$) as shown in FIGS. 3 and 4, respectively, are individually designed and manufactured to be connected to one another for creating building materials for all the four quadrants, which are then assembled to one another to provide a particular floor of the elliptical structure (A), and all the floors are jointed to one another to provide an entire elliptical structure (A).

The present invention can provide efficient and economic means for serving the design, drawing, land survey, manufacture, and construction in building an elliptical structure on a particular site. The present invention allows forming the outline of an elliptical structure by connecting circular segments while smoothly forming the joint of the respective circular segments, and makes it possible to perform the related computation by setting the radii of the respective circular segments and the required angles, thus permitting efficient construction of elliptical structures. Such elliptical structures are excellent in structural strength, durable, and helpful to prevent strong wind blowing along a street of highrise buildings.

What is claimed is:

1. A method for producing a drawing of an elliptical structure which is symmetrical about the major axis and the minor axis thereof, comprising the steps of:

establishing predetermined major and minor axes of the elliptical structure on a viewing medium, which major and minor axes define quadrants of the elliptical structure;

drawing a first quadrant of the elliptical structure on the viewable medium by a) drawing with an instrument a first circular segment of the first quadrant by i) arbitrarily establishing a first fixed point selected from an infinite number of usable points along an extension of the minor axis; and ii) drawing the first circular segment, beginning at the farthest end point of the minor axis from said first fixed point, through an arbitrary angle selected from an infinite number of usable angles as measured at said first fixed point to a first end point of the first circular segment, the first circular segment having a center at the first fixed point and having a radius equal to a distance of a first straight line segment extending between the first end point and the first fixed point;

b) drawing with an instrument a second circular segment of the first quadrant by i) arbitrarily establishing a second fixed point selected from an infinite number of usable points along said first straight line segment; and ii) drawing the second circular segment, beginning at said first end point of said first circular segment, through an arbitrary angle selected from an infinite number of usable angles as measured at said second fixed point to a second end point of the second circular segment, the second circular segment having a center at the second fixed point and having a radius equal to a distance of a second straight line segment extending between the second end point and said second fixed point;

c) drawing with an instrument a third circular segment of the first quadrant by i) arbitrarily establishing a third fixed point selected from an infinite number of usable points along said second straight line segment; and ii) drawing the third circular segment, beginning at the second end point of said second circular segment, through an arbitrary angle selected from an infinite number of usable angles as measured at said third fixed point to a third end point of the third circular segment, the third circular segment having a center at the third fixed point and having a radius equal to a distance of a third straight line segment extending between the third end point and said third fixed point;

d) repeating step c) for (n−1) further circular segments as required; and e) finally drawing with an instrument an nth and final circular segment of the first quadrant by i) establishing an nth fixed point where an (n−1)th straight line segment intersects the major axis, and ii) drawing the nth circular segment, beginning at an (n−1)th end point of an (n−1)th circular segment, to the major axis, the nth circular segment having a center at the nth fixed point and having a radius equal to a distance from the nth fixed point to the (n−1)th end point; and drawing second, third and fourth quadrants of the elliptical structure on the viewable medium with the instrument by repeating steps a) to e) to produce a drawing of the elliptical structure.

2. An elliptical structure which has an outline of the drawing of the elliptical structure, being constructed using building materials designed by the method as claimed in claim 1.

3. A method for producing a drawing of an elliptical structure which is symmetrical about the major axis and the minor axis thereof, comprising the steps of:

establishing predetermined major and minor axes of the elliptical structure on a viewing medium, which major and minor axes define quadrants of the elliptical structure;

drawing a first quadrant of the elliptical structure on the viewable medium by a) drawing with an instrument a first circular segment of the first quadrant by i) arbitrarily establishing a first fixed point selected from an infinite number of usable points along an extension of the minor axis; and ii) drawing the first circular segment, beginning at the farthest end point of the minor axis from said first fixed point, through an arbitrary angle selected from an infinite number of usable angles as measured at said first fixed point to a first end point of the first circular segment, the first circular segment having a center at the first fixed point and having a radius equal to a distance of a first straight line segment between the first fixed point to the farthest end point;

b) drawing with an instrument a second circular segment of the first quadrant by i) arbitrarily establishing a second fixed point selected from an infinite number of usable points along said first straight line segment; and ii) drawing the second circular segment, beginning at said first end point of said first circular segment, through an arbitrary angle selected from an infinite number of usable angles as measured at said second fixed point to a second end point of the second circular segment, the second circular segment having a center at the second fixed point and having a radius equal to a distance of a second straight line segment between the second end point and said second fixed point;

c) finally drawing with an instrument a third and final circular segment of the first quadrant part by drawing the third circular segment, beginning at the second end point of the second circular segment, to the major axis, the third circular segment having a center at an intersecting point of the second straight line segment and the major axis and having a radius equal to a part of the second straight line segment; and d) drawing second, third and fourth quadrants of the elliptical structure with the instrument by repeating steps a) to c) to produce a drawing of the elliptical structure.

4. An elliptical structure which has an outline of the drawing of the elliptical structure, being constructed using building materials designed by the method as claimed in claim 3.

* * * * *